US006328178B1

(12) United States Patent
Hsu

(10) Patent No.: US 6,328,178 B1
(45) Date of Patent: Dec. 11, 2001

(54) COLLAPSIBLE CONTAINER

(75) Inventor: Mu-Chuan Hsu, Tainan (TW)

(73) Assignee: L & F Plastics Co. Ltd., Taipei (TW)

( * ) Notice: Subject to any disclaimer, the term of this patent is extended or adjusted under 35 U.S.C. 154(b) by 0 days.

(21) Appl. No.: 09/738,100

(22) Filed: Dec. 15, 2000

(51) Int. Cl.[7] ..... B65D 11/18; B65D 7/24
(52) U.S. Cl. ..... 220/7; 220/6
(58) Field of Search ..... 220/7, 6, 428

(56) References Cited

U.S. PATENT DOCUMENTS 3,552,466 * 1/1971 Fairchilds ..... 220/7
3,809,278 * 5/1974 Csumrik ..... 220/7
4,693,386 * 9/1987 Hughes et al. ..... 220/7
4,887,874 * 12/1989 Joffe ..... 220/7
4,978,020 * 12/1990 Aono ..... 220/7

* cited by examiner

*Primary Examiner*—Joseph M. Moy
(74) *Attorney, Agent, or Firm*—Alan Kamrath; Rider, Bennett, Egan & Arundel, LLP

(57) ABSTRACT

A collapsible container includes a container body and a separate front wall combined together. The container body has a bottom wall and two sidewalls and a rear wall and an open front side and an open upper side. The two sidewalls and the rear wall may be collapsed to lie on the bottom wall by means of insert hooks provided at two ends of the rear wall and hook holes provided at a rear end of the two side walls. Then the collapsible container is easy to assemble, having small dimensions for easily storing and reducing cost for transporting when it is collapsed.

1 Claim, 5 Drawing Sheets

COLLAPSIBLE CONTAINER

BACKGROUND OF THE INVENTION

This invention relates to a collapsible container, particularly to one having a container body with three side walls collapsible on the bottom wall and a separate front sidewall to be combined with the container body, convenient to assemble and collapse for saving space for storing by placing vertically one by one and reducing cost for transportation.

At present conventional containers for storing good s have many kinds for selecting, and most of them are almost formed integral, not collapsible, some are made to consist of a container body and a front side separately made to combined with the container body made of three vertical sides. However, most conventional containers not collapsible requires a comparatively large space for storing and transportation, resulting in their high cost.

SUMMARY OF THE INVENTION

This invention has been devised to offer a collapsible container composed of a container body with three vertical sidewalls collapsible and a separate front sidewall combined to the collapsible container body. The feature of the invention is the collapsible container body having a rear sidewall and two opposite sidewalls, and the two ends of the rear sidewall provided with a bent narrow strip having plural insert hooks spaced apart. Then the two sidewalls have their rear ends provided with insert holes formed space apart for the insert hooks to hook to constitute the container body and then combined with the separate front sidewall to become a complete container with an open upper side.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
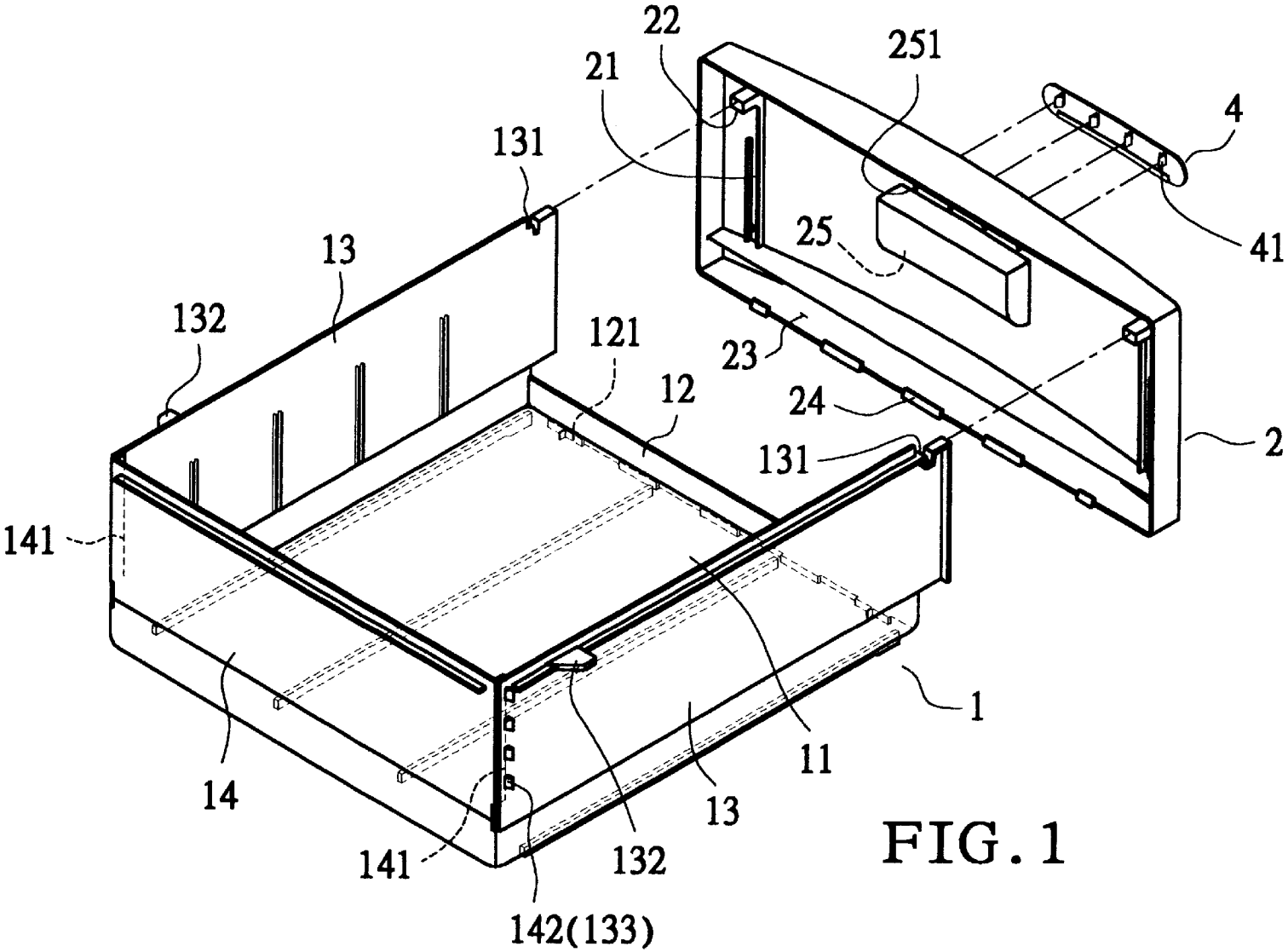
FIG. 1 is an exploded perspective view of a collapsible container in the present invention.
Figure 2:
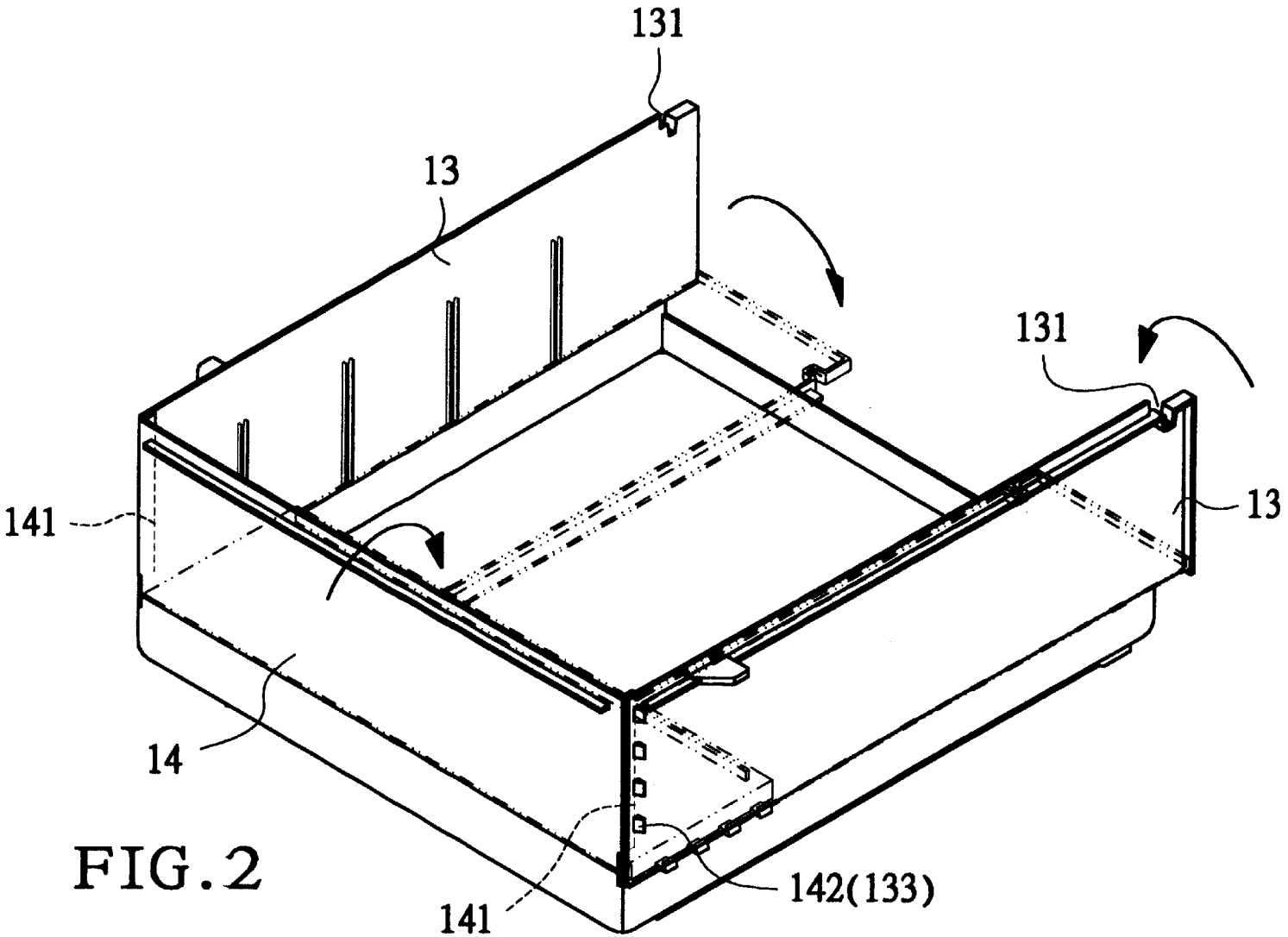
FIG. 2 is a perspective view of a container body in the present invention, showing how to collapse the container body.
Figures 3, 4:
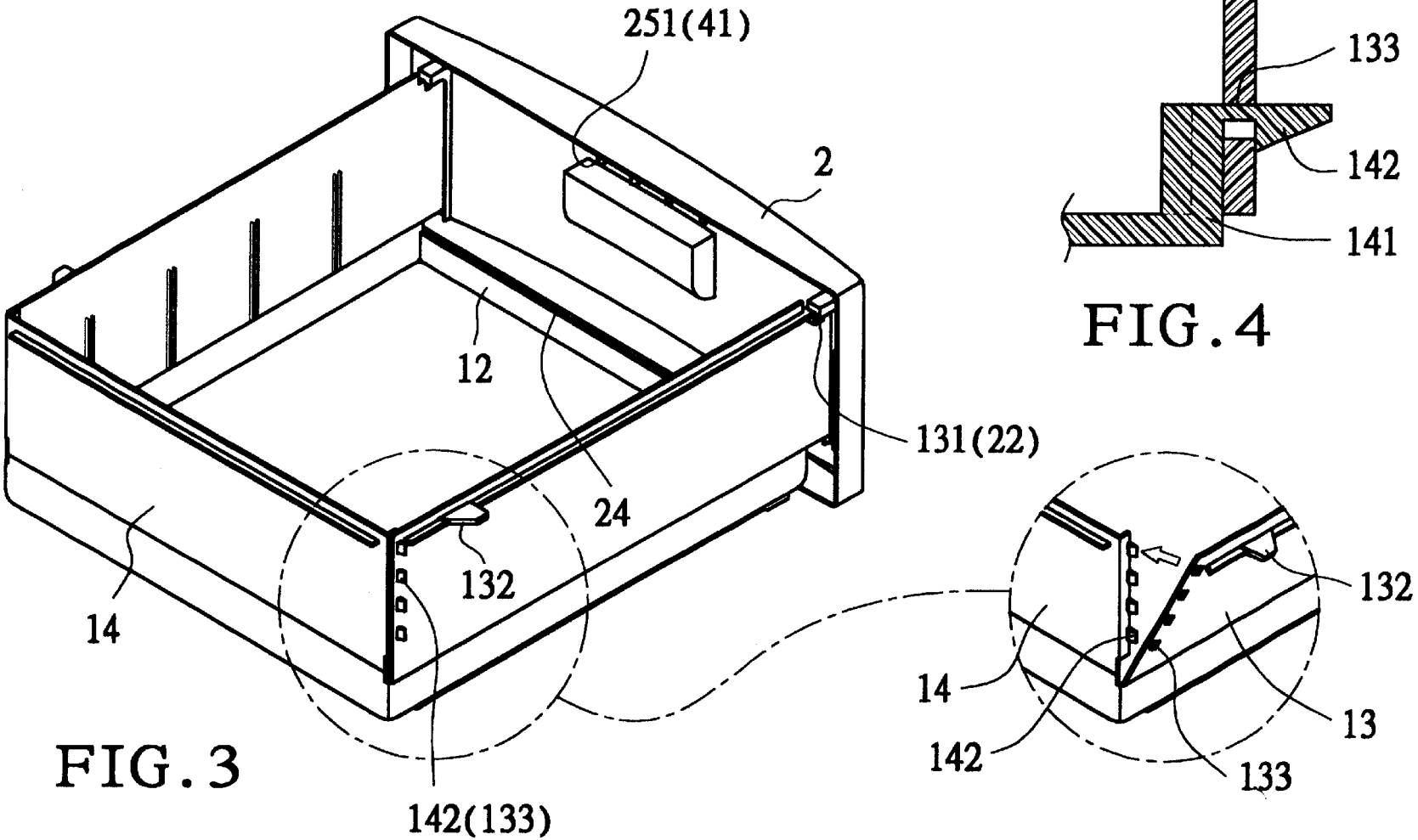
FIG. 3 is a perspective view of the collapsible container completely combined in the present invention.
FIG. 4 is a partial cross-sectional view of a corner formed by a third rear sidewall combined with a first or a second sidewall in the present invention.
Figure 5:
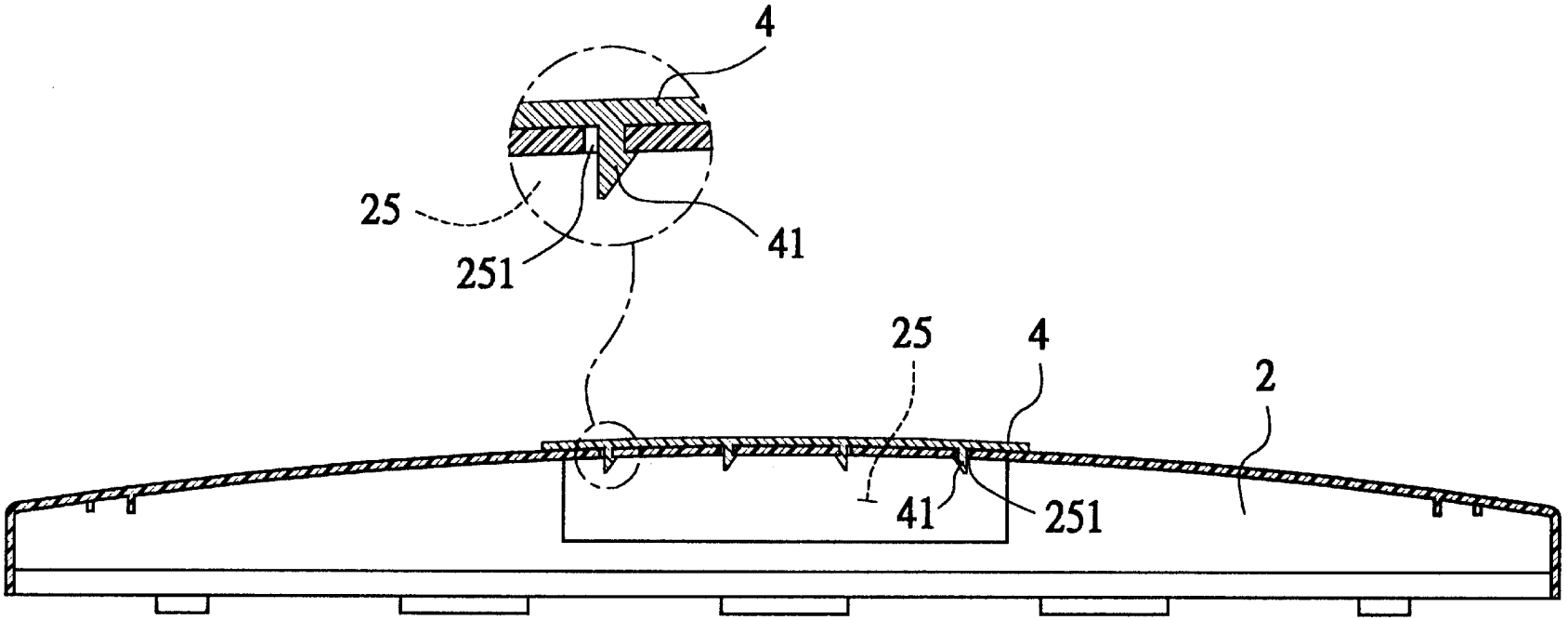
FIG. 5 is an upper view of a separate front sidewall in the present invention: and, FIG. 6 is a cross-sectional view of the collapsible container in the present invention.

A preferred embodiment of a collapsible container in the present invention, as shown in FIG. 1, includes a container body 1 and a separate front sidewall 2 as main components combined together.

The container body 1 consists of a bottom wall 11, four low rods 12 surrounding the bottom wall 11, two opposite side walls 13 bendably placed on the low rods 12, and a rear sidewall 14 also bendably placed on one of the low rods 12. The two sidewalls 13 and the rear sidewalls 14 are all made of tough material. The front low rod 12 has fit projections 122 on an lower inner end to align to plural fit projections 23 provided on a front edge of a lower horizontal strip of a second fit member 24 consisting of two parallel flat strips defining a long gap to fit with the front rod 12 of the container body 1. The two sidewalls 13 have respectively a stop projection 133 formed to extend outward from an upper end. The rear wall 14 of the container body 1 has a bent narrow strip 143 formed vertically in two opposite ends and respectively provided with plural insert hooks 144 spaced apart, and the two side walls 13 respectively have plural insert holes 134 spaced apart in a rear end for the insert hooks 144 of the rear walls 14 to hook with to assemble the container body 1.

The separate front side wall 2 is combined with the container body 1, positioned at a front side of the container body 1, having two vertical fit member 22 consisting of two vertical strips fixed and separated with gap on an inner surface, a fit block 21 formed respectively at a top end of one of the two vertical strips 22, and a horizontal fit member 24 consisting of two flat horizontal strips formed at a lower end portion of the separate front wall 2 and the hook blocks 23 spaced apart on a front edge of the lower flat horizontal strip. Further, the front side wall 2 has a rectangular recess 25 formed in an intermediate portion and plural fit holes 251 formed in a front wall of the recess 25 for fit studs 41 of a grip 4 to fit therein to combine the grip 4 with the front sidewall 2 for pushing or pulling the front sidewall 2.

Figure 6:
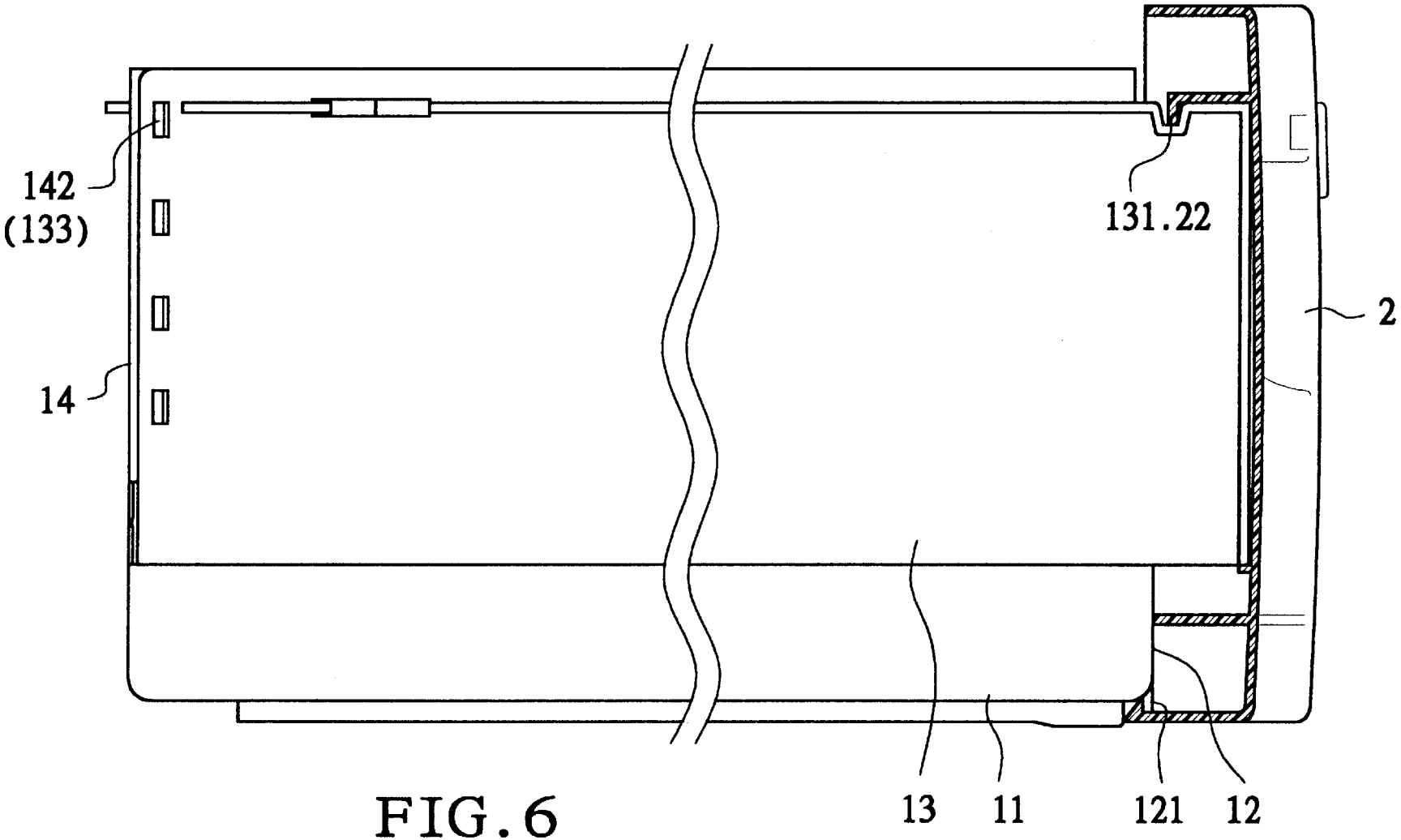

As described, the container body 1 is assembled with the two side walls 13 combined with the rear wall 14 by means of the insert hooks 144 hooking in the insert holes 134. Then the separate front sidewall 2 is combined with the container body 1 by means of the vertical fit member 22 with the gap fitting a front vertical end of each of the two side walls 13 and each fit block 21 engaging the notch 131 of each of the two side walls 13, forming the front sidewall of the collapsible container with no upper side in the invention. In addition, the fit projection 122 engaging a front end edge of the separate front sidewall 2 to stabilize the front sidewall with the container body 1 as shown in FIG. 6.

Thus, the collapsible container in the invention is easily assembled or disassembled to economize the space needed for storing and transportation.

While the preferred embodiment of the invention has been described above, it will be recognized and understood that various modifications may be made therein and the appended claims are intended to cover all such modifications that may fall within the spirit and scope of the invention.

I claim:

1. A collapsible container comprising a container body having a bottom wall, four low rods surrounding four side s of said bottom wall, two opposite sidewall s on two of said first low rods, a rear wall on one of said first low rods, said two side walls and said rear wall all made of tough material, a front one of said four low rods having plural fit projections formed spaced apart on a lower edge, said two sidewalls respectively having a stop projection outwardly projecting from a rear upper portion, plural insert holes formed spaced apart vertically in a rear end and a notch formed in a front upper end, said rear wall having a bent strip formed respectively in two ends, said bent strip having plural insert hooks spaced apart, said insert hooks of said rear wall hooking said insert holes of said side walls so as to assemble said container body;

a separate front sidewall combined with said container body to form a front sidewall of said collapsible container, having a vertical fit member fixed on two sides of an inner surface, each said vertical fit member having two parallel strips defining a gap between them, a horizontal fit member formed in a lower end and having two parallel flat strips defining a long gap to fit with said front rod of said container body:

said vertical fit member of said separate front wall fitting with a front end edge of each said sidewall, said horizontal fit member fitting with said front low rod of said container body;

said container body having said rear wall bendably placed on one of said four rods and then said two side walls bendably placed on two of said four rods to collapse said container body, said separate front sidewall possible to assemble with and dissemble from said container body to form a complete container for easily saving space for storing and reducing cost for transportation.

* * * * *